United States Patent [19]

Komatsu et al.

[11] 4,124,413

[45] Nov. 7, 1978

[54] WEAR AND PITTING RESISTANT CAST IRON

[75] Inventors: Yasuhiko Komatsu; Shozo Kanbara, both of Toyota, Japan

[73] Assignee: Toyota Jidosha Kogyo Kabushiki Kaisha, Toyota, Japan

[21] Appl. No.: 559,420

[22] Filed: Mar. 18, 1975

[30] Foreign Application Priority Data

Mar. 18, 1974 [JP] Japan ..... 49-030832

[51] Int. Cl.[2] ..... C21D 5/00

[52] U.S. Cl. ..... 148/3; 75/128 C; 75/128 D; 75/128 W; 148/35; 148/141

[58] Field of Search ..... 75/123 CB, 128 C, 128 D, 75/128 W; 148/35, 138, 139, 140, 141, 3

[56] References Cited

U.S. PATENT DOCUMENTS

| | | | |
|---|---|---|---|
| 1,391,215 | 9/1921 | Speer | 75/128 D |
| 1,627,626 | 5/1927 | Walters | 75/128 D |
| 1,910,034 | 5/1933 | Mitchell et al. | 75/128 D |
| 1,973,263 | 9/1934 | Mitchell et al. | 75/128 D |
| 2,077,117 | 4/1937 | Lauenstein | 148/141 |
| 2,171,082 | 8/1939 | Ervin | 75/128 D |
| 2,324,322 | 7/1943 | Reese et al. | 148/35 |
| 2,338,171 | 1/1944 | Feduska | 148/138 |
| 2,455,183 | 11/1948 | Lobdell | 75/128 D |
| 3,370,934 | 2/1968 | Smith | 148/35 |
| 3,549,431 | 12/1970 | de Castelet | 148/141 |
| 3,627,515 | 12/1971 | Kueny | 75/128 D |
| 3,977,867 | 8/1976 | Cochran et al. | 148/35 |

OTHER PUBLICATIONS

Metals Handbook, 1948 Ed., pp. 512, 513 & 519.

*Primary Examiner*—R. Dean
*Attorney, Agent, or Firm*—Brisebois & Kruger

[57] ABSTRACT

Wear and pitting resistant cast iron consisting essentially of 2.8 - 3.3% carbon, 1.5 - 2.1% silicon, 1.0 - 1.5% chromium, 0.6 - 0.8% molybdenum, 0.2 - 0.5% nickel, balance substantially all iron. The free cementite in the iron in its as-cast state amounts to 20 - 40% by volume and the casting is then held at 860° - 950° C for 1 - 10 hours, followed by quenching, for hardening purposes.

7 Claims, 2 Drawing Figures

WEAR AND PITTING RESISTANT CAST IRON

BACKGROUND OF THE INVENTION

These are four known methods of improving the wear and pitting resistant properties of cast iron products. One is surface treatment such as chromium-plating, nickel plating, and soft nitriding. Another is metallizing with molybdenum or iron. These two methods are highly effective for increasing the wear resistance but the production cost is high on account of the complicated processes involved. A third method is induction hardening or flame hardening. This method is relatively easy to carry but cannot yield sufficient wear resistance. A fourth method is chilled casting using a chiller in the mold. Since it is easy to carry out and considerably improves the wear resistance, this method is widely used; but castings which must serve under extremely severe conditions such as the camshafts, valve-lifters or valve rocker-arms of engines, etc., which have been produced by this method, have been found lacking in wear resistance and pitting resistance and are often found unsatisfactory with respect to pitting and wear.

There is also a known "hardenable" cast iron which is a kind of gray cast iron including small additions of alloying elements such as chromium, molybdenum, nickel, etc.; this is said to possess high pitting resistance; but when applied in a small, fast-running engine of the type produced in Japan, it wears badly and its resistance to pitting cannot be called satisfactory. This hardenable cast iron is characterized in that since it contains cementite and graphite half crystallized in the as-cast state, the matrix can be given a hardened structure through induction hardening or flame hardening; but even this hardened structure is not completely satisfactory with respect to pitting resistance.

SUMMARY OF THE INVENTION

The present invention relates to a wear-resistant, pitting resistant cast iron, which is an improvement on "hardenable" cast iron.

An increase in the amount of free cementite in the as-cast state is commonly believed to be an effective method of improving wear resistance, but too much free cementite will make subsequent hardening difficult. Hardening also becomes difficult because the alloying elements added for better hardenability of the matrix structure are preferentially absorbed into the free cementite so that the hardenability of the matrix is impaired.

In view of this fact, the object of the present invention is to provide a new kind of wear resistant, pitting resistant cast iron, the hardenability of which has been improved by restricting the volume of free cementite in its as-cast state as well as by modifying its chemical composition and the hardening conditions.

DETAILED DESCRIPTION OF THE INVENTION

Figure 1:
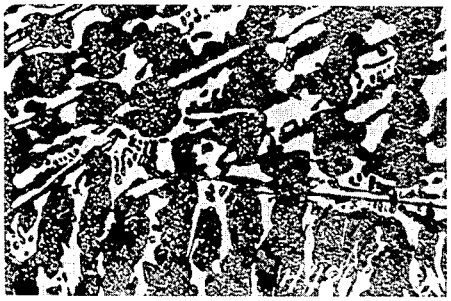
FIG. 1 is a photograph showing the microstructure of the cast iron according to the present invention, after hardening.

The following is a detailed description of the wear resistant, pitting resistant cast iron according to the present invention.

The cast iron according to the present invention is composed of 2.8–3.3% carbon, 1.5–2.1% silicon, 1.0–1.5% chromium, 0.6–0.8% molybdenum, 0.2–0.5% nickel, and the balance substantially all iron, and containing 20–40% free cementite in its as-cast state, after having been heated at 860° C.–950° C. for 1–10 hours and then quenched to give a Vickers hardness of 750–900 (Hv).

The significance of the chemical composition of the cast iron will now be explained.

With a carbon content less than 2.8%, casting defects are likely, but with more than 3.2% carbon, too much graphite is formed, together with too little free cementite. For this reason, the carbon content should be 2.8–3.2%.

With a silicon content less than 1.5%, casting defects are liable to occur and at the same time too much free cementite may form. With a silicon content of more than 2.1%, on the contrary, too little free cementite is formed, while flaky graphite is crystallized. For this reason the silicon content should be 1.5–2.1%.

When the metal contains more than 0.05% phosphorus its wear resistance will not be adversely affected, but tiny shrinkage holes may be produced. Thus the desirable phosphorus content is less than 0.05%.

When there is less than 1.0% chromium, the volume of its solid solution in the matrix will decrease, resulting in poor hardenability of the cast iron. When there is more than 1.5% chromium, however, the amount of free cementite will increase; the cementite itself becomes extremely brittle; and during quenching, cracks are likely to occur.

Molybdenum and nickel have no great direct effect on the volume of free cementite or on the properties of the cast iron, but when present together with chromium, they are expected to exert a desirable effect. They are also highly effective in improving the hardenability of the matrix. To serve this purpose, the molybdenum content has to be more than 0.6% and the nickel content more than 0.2%. With more than 0.8% molybdenum and more than 0.5% nickel, no conspicuous improvement in their effect can be expected, so these values are taken as their economical upper limits.

Based on these findings, the chemical composition of the cast iron according to the present invention should be as follows:

carbon 2.8–3.3%, silicon 1.5–2.1%,
phosphorus less than 0.05%, chromium 1.0–1.5%,
molybdenum 0.6–0.8%, nickel 0.2–0.5%, balance substantially all iron.

Practically, it is necessary to select the optimum chemical composition in dependence on the size and shape of the cast product so that the volume of free cementite in the as-cast state may be 20–40%.

In conventional "hardenable" cast iron with a large carbon and silicon content and a small amount of alloying elements, the volume of free cementite is as low as about 20% and the hardenability of its matrix is satisfactory, but the hardness after quenching is at the most $H_v$700, which poses a problem with regard to its wear resistance. At the same time, when the free cementite content in the as-cast state approaches 60% by volume, the hardenability of the matrix seriously deteriorates, making it impossible to obtain sufficient hardness after quenching. If hardening is forced, the product will not be sound since hardening cracks will develop therein. Thus the volume of free cementite should be 20–40%. The volume of free cementite can be adjusted by appropriate selection of the chemical composition, the casting temperature and the casting method, and by cooling the casting mold.

When the free cementite content exceeds 20% by volume, often the product cannot be satisfactorily hardened under the common hardening conditions. Therefore a method has been worked out according to which, for the purpose of satisfactorily hardening a product with a free cementite content of 20–40% by volume, the product can be heated at over 860° C. for more than one hour and can be quickly cooled without developing hardening cracks. Long-time heating at high temperature is intended to dissolve the angular part of free cementite into the matrix and increase the solid solution of alloying elements in the matrix, thereby improving the hardenability of the matrix. The rounding of angular free cementite and the thickening and shortening of elongated free cementite have a significant effect in inhibiting the development of cracks and improving pitting resistance.

Next, several specific embodiments of the present invention will be described.

EXAMPLE 1

This example is a valve-lifter for a 2000 C.C. engine which is made of cast iron according to the present invention.

In a casting mold prepared by the $CO_2$ process, a cast iron product consisting of 3.1% carbon, 1.8% silicon, 0.6% manganese, 0.04% phosphorus, 0.04% sulfur, 1.15% chromium, 0.35% nickel, 0.75% molybdenum and the balance substantially all iron was cast at 1400° C. The free cementite content in this product in its as-cast state was 30–40% by volume. This product was heated at 860° C. for 2 hours, followed by quenching in oil at 60° C. and then by tempering for 1 hour at 150° C.

The Vickers hardness after quenching was 790–850 Hv. The microstructure (at a magnification of × 400) of this cast iron after hardening is shown in FIG. 1. For reference the microstructure (at a magnification f × 400) of this cast iron before hardened is shown in FIG. 2.

Figure 2:
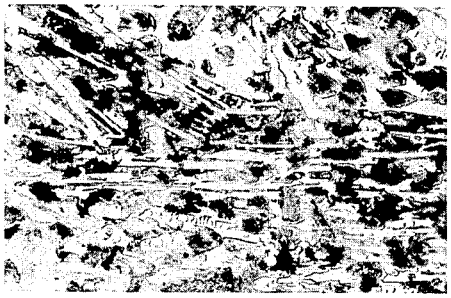
FIG. 2 is a photograph showing the microstructure of the cast iron of FIG. 1, before it has been hardened.

The free cementite in FIG. 1 is apparently more rounded than the one in FIG. 2; it is seen that a long grain is split into thick, short pieces. A big grain of as-cast free cementite in FIG. 2 was as long as 0.05–0.09 mm, but a hardened free cementite grain in FIG. 1 was 0.05–0.08 mm in length.

A valve-lifter cast in this manner was assembled into an engine and subjected to an endurance test of 1,000 hours at 2000 rpm, in which no observable pitting and no wear occurred in the valve-lifter. In this test the camshaft was made of a chilled gray cast iron according to JIS FC-25.

For comparison, a similar endurance test was conducted using a cast iron, similar to a hardenable cast iron containing 3.4% carbon, 2.3% silicon, 0.8% chromium, 0.5% molybdenum, 0.3% nickel, the balance being substantially all iron. As-cast the free cementite content was 18%; and its hardness after quenching 680 (Hv). In 500 hours of testing, more than half the valve-lifters tested suffered pitting and were worn down by as much as 0.1–0.2 mm. On the other hand, a casting mold for a valve-lifter was prepared by the $CO_2$ process and a valve-lifter was cast in this mold at 1400° C., with a chiller placed in the mold to accelerate cooling, from a cast iron comprising 3.30% carbon, 2.1% silicon, 0.68% manganese, 0.045% phosphorus, 0.82% chromium, 0.43% molybdenum, 0.24% nickel, balance substantially all iron. The volume of free cementite in as-cast product was 50–60%.

The valve-lifter was heated at 870° C. for 1 hour followed by quenching in an oil at 60° C. and then by tempering for 1 hour at 150° C. Its hardness after tempering was as low as 680–720 (Hv). Meanwhile the valve-lifter assembled into an engine was subjected to the same endurance test as above, in which pitting occurred during 250 hours of testing. This is believed to be due to the presence of an insufficient quantity of alloying elements in solid solution in the matrix on account of excess carbide, and due to poor hardenability because the total content of alloying elements (particularly molybdenum) is small.

Furthermore, a valve-lifter mold was prepared by the shell mold process and in this mold a valve-lifter was cast at 1400° C. from a cast iron comprising 3.32% carbon, 2.1% silicon, 0.65% manganese, 0.043% phosphorus, 0.7% chromium, 0.54% molybdenum, 0.27% nickel, balance substantially all iron. This valve-lifter was held at 920° C. for 10 hours followed by the same heating, quenching and tempering as above. After this treatment it exhibited a Vickers hardness as low as 670–710 Hv.

Also the valve-lifter was assembled into an engine and subjected to the same endurance test as above, in which pitting occurred within 150 hours. This is believed to be due to a low Vickers hardness (Hv) resulting from the decomposition of carbide after 10 hours of holding at 920° C. and due to deterioration of the wear resistance because of a low carbide content.

EXAMPLE 2

This is an example of the valve rocker-arm in an 1800 C.C. OHC engine made of cast iron according to the present invention.

In a casting mold prepared by the shell mold process a valve rocker-arm was cast at 1450° C. from a cast iron comprising 3.0% carbon, 1.9% silicon, 0.45% manganese, 0.05% phosphorus, 1.1% chromium, 0.65% molybdenum, 0.3% nickel, balance substantially all iron. The free cementite content in the as-cast product was 25–35% by volume. The product was heated at 900° C. for 1.5 hours, followed by cooling to 850° C., quenching in oil at 60° C., and then tempering for 1 hour at 150° C. The Vickers hardness after quenching (Hv) was 800–890 and the largest grains of free cementite were as long as 0.05–0.075 mm.

The valve rocker-arm cast in this manner was assembled into an engine and subjected to an endurance test for 400 hours at 4500 rpm, in which the wear was as little as about 0.02 mm and no pitting occurred. The camshaft used in this test was made of JIS FC-25 gray cast iron, which had been chilled and then soft nitrided.

For comparison, a valve rocker-arm was fabricated of JIS FC-30 gray cast iron chilled and subjected to the same endurance test as above, in which the wear was as much as 0.1–0.2 mm. The chilled Vickers hardness of the cast iron used in the test was 550–600 (Hv).

EXAMPLE 3

In a green sand mold a product was cast at 1430° C. from a cast iron comprising 3.25% carbon, 1.6% silicon, 0.55% manganese, 0.04% phosphorus, 1.4% chromium, 0.75% molybdenum, 0.4% nickel, balance substantially all iron. The free cementite content in the as-cast product was 26–40% by volume. The product was heated at 950° C. for 1.0 hour, followed by cooling to 820° C., quenching in oil at ambient temperature and then tempering for 1 hour at 150° C. The Vickers hardness after quenching was 790–900 (Hv), and the largest free cementite grains were as long as 0.03–0.06 mm.

A one-hour wet abrasion test was performed on a test specimen (30 × 50 × 10 mm) taken from the product and a companion specimen of FC 23, 50 × 5 mm, under a load of 50 kg at a sliding speed of 10 m/sec.

For comparison, a test specimen made of a chilled JIS FC-25 gray cast iron having a chromium content of 0.8%, a molybdenum content of 0.4% and a nickel content of 0.3% was subjected to the same abrasion test as above, the results being summarized in Table 1.

Table 1

| Test items | Cast iron test specimen of present invention | Compared specimen |
|---|---|---|
| Weight decrement (ring) | 2.2 mg | 1.8 mg |
| Abrasive scratch width (block) | 1.3 mm | 7.0 mm |

This showed that when the wear and pitting resistant cast iron of the present invention is used, a product, even when placed in service under severe conditions, suffers little abrasion and is relatively free from pitting.

Next, a few examples and references are tabulated in Table 2.

Table 2

| | ALLOY COMPOSITION | | | | | | | | | CASTING | | HOLDING CONDITION | | QUENCHING | | PROPERTIES | |
|---|---|---|---|---|---|---|---|---|---|---|---|---|---|---|---|---|---|
| EX. | C | Si | Mn | P | S | Cr | Mo | Ni | Fe | Temp. | Free cementite (Vol %) | Temp. | Hrs. | Temp. | Oil Temp. | Hardness (Hv) | Cementite length (mm) |
| Ex. 4 | 2.8 | 2.1 | | | | 1.10 | 0.68 | 0.25 | Bal | 1400° C | 20–27 | 880° C | 2.0 | 870° C | 60° C | 830–850 | 0.07–0.12 |
| Ex. 5 | 3.3 | 1.5 | | | | 1.15 | 0.72 | 0.27 | Bal | 1450 | 20–25 | 870 | 10 | 870 | 60 | 800–840 | 0.05–0.07 |
| Ex. 6 | 3.0 | 1.9 | | | | 1.0 | 0.70 | 0.30 | Bal | 1420 | 25–35 | 900 | 3 | 880 | 60 | 820–870 | 0.07–0.11 |
| Reference 1 | 3.0 | 1.4 | 0.5 | 0.05 | 0.1 | 1.2 | 0.7 | 0.3 | Bal | 1400 | | | | | | | |
| Reference 2 | 3.0 | 1.9 | 0.45 | 0.05 | | 1.1 | 0.65 | 0.3 | Bal | 1450 | 25–35 | 840 | 1 | 840 | 60 | 640–680 | |
| Reference 3 | 3.0 | 1.9 | 0.45 | 0.05 | | 1.1 | 0.65 | 0.3 | Bal | 1450 | 25–35 | 880 | 0.5 | 850 | 60 | 630–690 | |
| Reference 4 | 3.0 | 1.9 | 0.45 | 0.05 | | 1.1 | 0.65 | 0.3 | Bal | 1450 | 25–35 | 900 | 12 | 850 | 60 | 670–730 | |

Note: In Reference 1, products with numerous blowholes and products with mars on the external surface are produced. In References 2 and 3, the corners of carbide are seldom rounded. It is nearly as good as in the state as cast without change of length. In Reference 4, the amount of carbide decreases to 13–17% resulting in separation of a fairly large amount of graphite.

What is claimed is:

1. Wear and pitting resistant alloyed cast iron consisting essentially of:

2.8–3.3% carbon,
1.5–2.1% silicon,
1.0–1.5% chromium,
0.6–0.8% molybdenum,
0.2–0.5% nickel,
not more than 0.05 phosphorus,
balance essentially iron,
said cast iron having a free cementite content of 20–40% by volume in its as-cast state and having been heated at 860°–950° C. for 1–10 hours after casting, and then quenched.

2. The cast iron of claim 1 which has been heated after casting for 1–10 hours at 860°–900° C.

3. The cast iron of claim 1 which has first been heated at 900°–950° C. for 1.0–1.5 hours after casting, and then quenched in oil from at ambient temperature to 150° C. after cooling to 820°–850° C.

4. The cast iron of claim 1 which has been cooled after said heating to 820°–880° C., and then quenched in oil at about 60° C. followed by tempering for about an hour at 150° C.

5. The cast iron of claim 1 having a Vickers hardness of Hv 750–900 after quenching.

6. The cast iron of claim 1 wherein the maximum length of free cementite in the cast iron is not greater than 0.12 mm.

7. A method of producing a wear resistant cast iron which comprises the steps of casting a melt consisting essentially of:

2.8–3.3% carbon,
1.5–2.1% silicon,
1.0–1.5% chromium,
0.6–0.8% molybdenum,
0.2–0.55 nickel,
not more than 0.05 phosphorus balance substantially all iron,
to form a casting having a free cementite content of 20–40% by volume, and then hardening the resulting casting by heating it at 860°–950° C. for 1–10 hours, and then quenching it to produce a product having a Vickers hardness of Hv 750–900.

* * * * *